US006174203B1

(12) United States Patent
Asao

(10) Patent No.: US 6,174,203 B1
(45) Date of Patent: Jan. 16, 2001

(54) CONNECTOR WITH HOUSING INSERT MOLDED TO A MAGNETIC ELEMENT

(75) Inventor: Kazuhiro Asao, Yokkaichi (JP)

(73) Assignee: Sumitomo Wiring Sysytems, Ltd. (JP)

( * ) Notice: Under 35 U.S.C. 154(b), the term of this patent shall be extended for 0 days.

(21) Appl. No.: 09/347,174

(22) Filed: Jul. 2, 1999

(30) Foreign Application Priority Data

Jul. 3, 1998 (JP) ..... 10-189182

(51) Int. Cl.[7] ..... H01R 13/66; H01R 33/945
(52) U.S. Cl. ..... 439/620; 439/38
(58) Field of Search ..... 439/38, 39, 620

(56) References Cited

U.S. PATENT DOCUMENTS

| | | | | |
|---|---|---|---|---|
| 5,213,522 | | 5/1993 | Kojima . | |
| 5,219,305 | | 6/1993 | Kawaguchi et al. . | |
| 5,246,387 | | 9/1993 | Liebich et al. . | |
| 5,401,175 | * | 3/1995 | Guimond et al. | 439/38 |
| 5,456,619 | * | 10/1995 | Belopolsky et al. | 439/620 |
| 5,660,551 | * | 8/1997 | Sakurai | 439/108 |
| 6,059,608 | * | 5/2000 | Benes | 439/620 |

FOREIGN PATENT DOCUMENTS

| | | |
|---|---|---|
| 0 682 386 | 5/1995 | (EP) . |
| 6-325835 | 11/1994 | (JP) . |
| WO 96/07219 | 3/1996 | (WO) . |

* cited by examiner

*Primary Examiner*—Khiem Nguyen
*Assistant Examiner*—Hae Moon Hyeon
(74) *Attorney, Agent, or Firm*—Anthony J. Casella; Gerald E. Hespos; Michael J. Porco

(57) ABSTRACT

A connector is provided with a highly reliable noise removing function. The connector includes a magnetic element (30) at a rear end portion of a housing (10), and tabs (14) are inserted through a rectangular hole (31) which is a through hole formed in the magnetic element (30). The housing (10) is provided with a magnetic element receptacle (24) having a rectangular tubular shape for enclosing the outer circumferential surface of the magnetic element (30). One end surface of the magnetic element (30) is exposed to the outside from the rear end surface of the magnetic element receptacle (24). Since the magnetic element (30) has its outer circumferential surface enclosed by the magnetic element receptacle 24, it can be protected from contact with other parts and prevented from being cracked. If the magnetic element 30 should be cracked, the crack can be easily detected since the one end surface of the magnetic element 30 is exposed from the magnetic element receptacle 24, and can be dealt with by the exchange of the magnetic element or the exchange of the connector.

7 Claims, 4 Drawing Sheets

CONNECTOR WITH HOUSING INSERT MOLDED TO A MAGNETIC ELEMENT

BACKGROUND OF THE INVENTION

1. Field of the Invention

The present invention relates to a connector provided with a magnetic element for removing noise and to a method for producing such connectors.

2. Description of the Related Art

Noise transmitted along an electric conductive path can be removed by passing a part of the electric conductive path through an annular magnetic element. A prior art connector that takes advantage of this known technique is disclosed in Japanese Unexamined Patent Publication No. 6-325835. This prior connector is shown in FIG. 7, and is provided with a housing 1. A magnetic element 2 of ferrite is provided at the front surface of the housing 1, and terminal fittings 3 are arranged at the back of through holes 2A formed in the magnetic element 2. The magnetic element 2 has its outer surface covered by a resin coating 4. The terminal fittings 3 are connected with mating terminal fittings inserted into the housing 1 through the through holes 2A of the magnetic element 2. Thus electric conductive paths continuous with the connector penetrate through the magnetic element 2. Accordingly, the noise transmitted along the electric conductive paths is removed by the magnetic element 2.

Magnetic elements used for the above purpose generally are obtained by sintering a ferrite powder. These magnetic elements disadvantageously are likely to be cracked by a shock or the like. If a closed loop of the magnetic element 2 enclosing an electric conductive path L is made open by a crack S, as shown in FIG. 8, the noise removing function cannot be obtained. However, the outer surface of the magnetic element 2 is covered by the resin coating 4 in the connector disclosed in the above publication. Consequently, the crack S that opens the closed loop of the magnetic element 2 cannot be found. Therefore, the reliability of the noise removing function of the prior art connector is low.

The present invention was developed in view of the above problem and an object of the present invention is to provide a connector having a highly reliable noise removing function.

SUMMARY OF THE INVENTION

According to the invention, there is provided a connector having an annular or toroidal magnetic element provided in a connector housing to remove noise transmitted along the electric conductive path that penetrates through the magnetic element. The connector housing comprises a magnetic element receptacle for accommodating the magnetic element. The receptacle substantially encloses the outer circumferential surface of the magnetic element and substantially exposes one end surface of the magnetic element to the outside.

Accordingly, since the magnetic element has its outer circumferential surface enclosed by the magnetic element receptacle in the connector, it can be protected from contact with other parts and prevented from being cracked. If the magnetic element should be cracked, the crack can be found easily since one end surface of the magnetic element is exposed from the magnetic element receptacle, and can be dealt with by the exchange of the magnetic element or the exchange of the connector. Therefore, the reliability of the noise removing function can be improved.

According to a preferred embodiment of the invention, the magnetic element is formed or inserted by insert-molding while being substantially accommodated in the magnetic element receptacle. Accordingly, since the magnetic element is formed by insert-molding while being accommodated in the magnetic element receptacle, an operation step of mounting the magnetic element in the housing can be omitted.

Preferably, the magnetic element is provided with one or more fixing holes for fixing the magnetic element to the connector housing by means of one or more holding members formed by molding. The one or more fixing holes may be stepped to widen at least at one of its opposite opening ends so that one or both of the opposite opening ends have a larger diameter than an intermediate portion of the fixing hole. Accordingly, the magnetic element can be held fixedly on the connector housing.

Still further preferably, the magnetic element is fixed to the connector housing by insert molding acting on a part of the outer surface of the magnetic element.

Most preferably, an outer surface of the magnetic element is formed at least partially with one or more recesses and/or one or more projections.

According to a further preferred embodiment of the invention, the magnetic element is provided with one or more openings for arranging therethrough the electric conductive path(s). Preferably, the one or more openings are provided such that one or more tabs project at least partially into a receptacle of the housing for connection with a mating connector extend therethrough.

According to the invention, there is further provided a method for producing a connector having an annular or toroidal magnetic element provided in a connector housing to remove a noise transmitted to an electric conductive path penetrating through the magnetic element. The method comprises the steps of accommodating the magnetic element in a magnetic element receptacle of the connector housing, substantially enclosing the outer circumferential surface of the magnetic element and substantially exposing one end surface of the magnetic element to the outside.

According to a preferred embodiment of the invention, the method further comprises the step of insert-molding the magnetic element while being substantially accommodated in the magnetic element receptacle.

These and other objects, features and advantages of the present invention will become more apparent upon a reading of the following detailed description and accompanying drawings.

DETAILED DESCRIPTION OF THE PREFERRED EMBODIMENT

A connector housing according to the invention is identified by the numeral 10 in FIGS. 1 to 6. The connector housing 10 is formed, e.g., of synthetic resin and is comprised of a tubular receptacle 11 and a mount base 12 provided behind the receptacle 11 (in a mating direction MD) for fixing the connector to a mating part (not shown).

Figure 2:
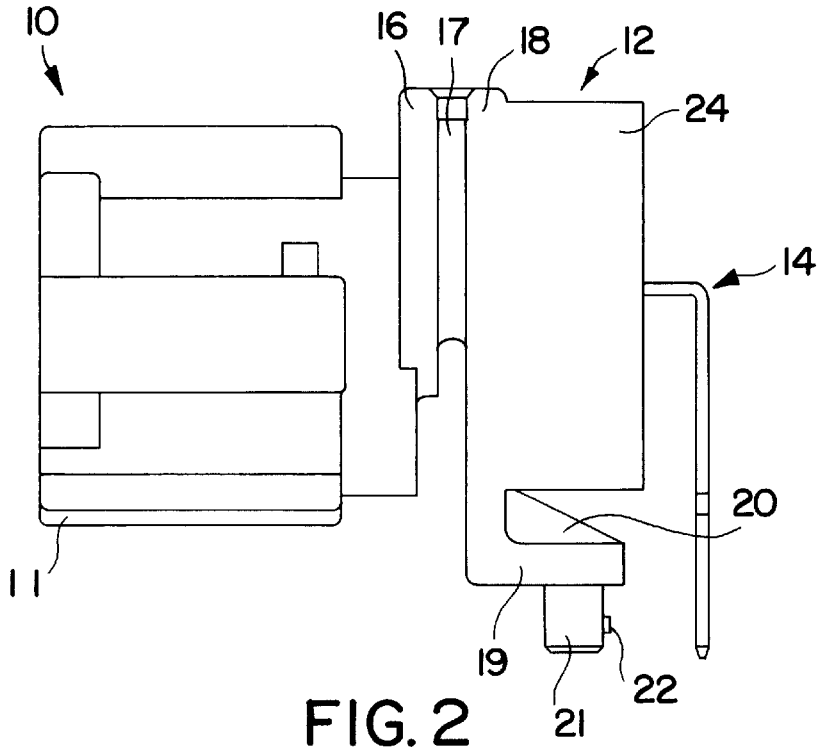
FIG. 2 is a side view of the connector.

The receptacle 11 has an opening 11A at one end thereof and has the other end thereof substantially closed by a back wall 13. One or more tabs 14 penetrate through the back wall 13. The tabs 14 are pushed into tab insertion holes 14A formed in the back wall 13 preferably from front of the housing 10, so that one end of each tab 14 at least partially projects toward the opening 11A from the back wall 13. When a mating connector is at least partially fitted into the receptacle 11 in the mating direction MD, one end of the each tab 14 is electrically connected with a corresponding terminal fitting provided in the mating connector. Further, as shown in FIG. 2, a flat plate 16 bulges out upwardly (in the plane of FIG. 2) at the rear end of the receptacle 11, and the mount base 12 is provided continuously behind the flat plate 16 via a necked portion 17.

Figure 1:
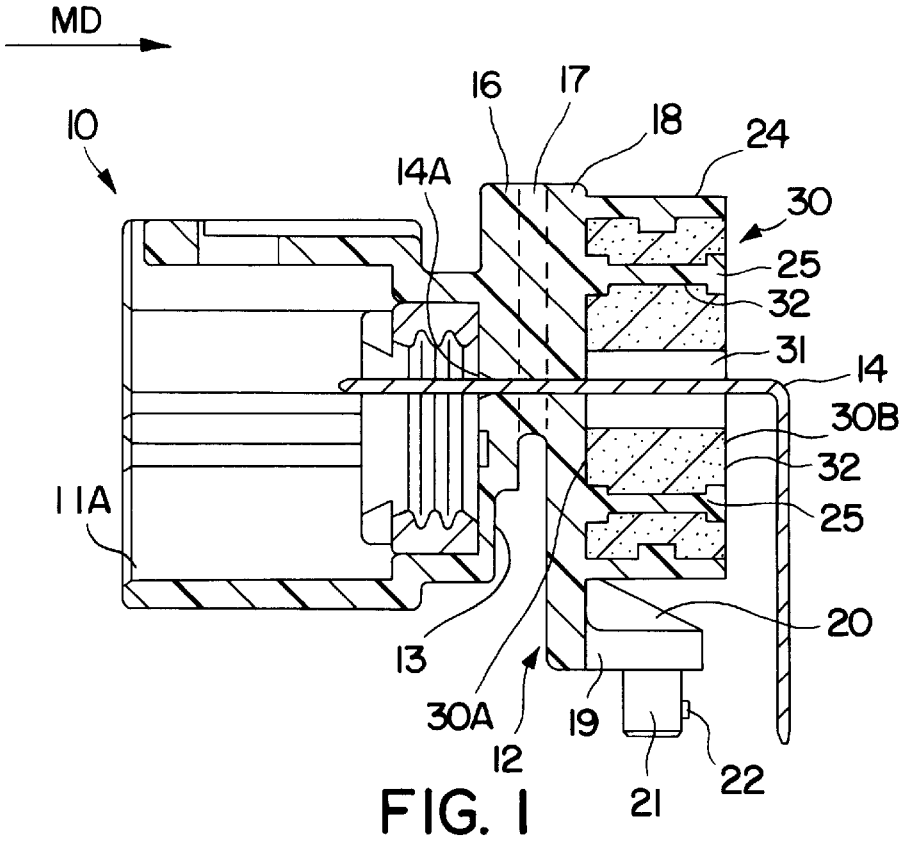
FIG. 1 is a side view in section of a connector according to one embodiment of the invention.

The mount base 12, as shown in FIG. 1, is provided with a substantially rectangular plate 18 which extends substantially parallel the flat plate 16 while defining a narrow space with the flat plate 16 via the necked portion 17. The upper end of the rectangular plate 18 is aligned with the upper end of the flat plate 16, and the bottom end thereof projects more downwardly than the receptacle 11. A pair of contact portions 19 bulge out backwardly at opposite sides of the bottom end of the rectangular plate 18, and one or more reinforcing ribs 20 are provided between the contact portions 19 and the rectangular plate 18. Embossments 21 project downwardly from the bottom surfaces of the respective contact portions 19. The embossments 21 are inserted into holes formed in the mating part to engage locking projections 22 formed on the circumferential surfaces of the embossments 21 with edges of the holes, thereby fixing the connector to the mating part.

The tabs 14 penetrate through the rectangular plate 18 and are bent downwardly at an angle different from 0° or 180°, preferably at substantially right angles in positions distanced from the rectangular plate 18 in a backward direction.

Figure 3A:
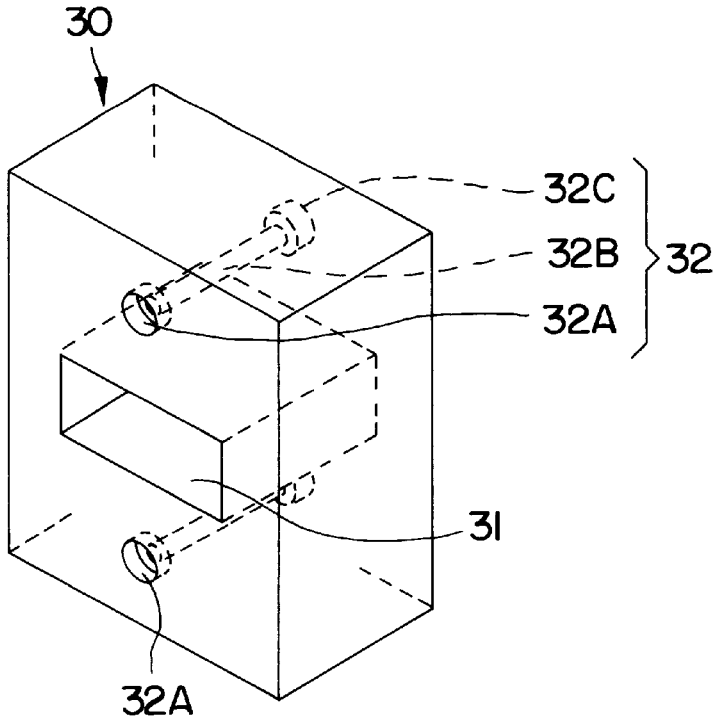
FIG. 3(A) is a perspective view of a magnetic element and FIG. 3(B) is a perspective view of the magnetic element having a crack.
Figure 3B:
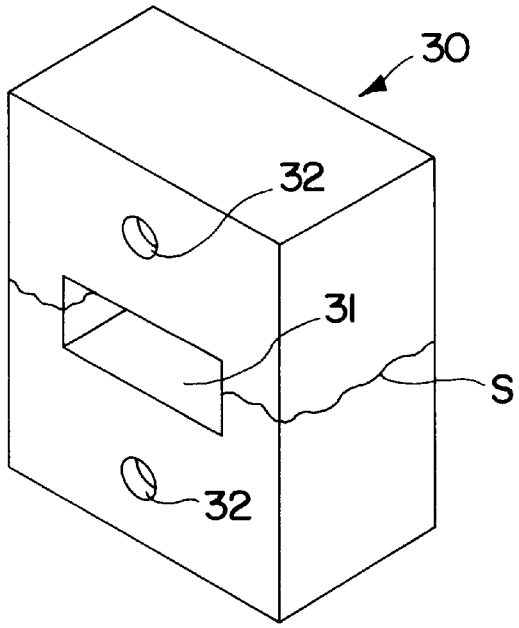
Figure 4:
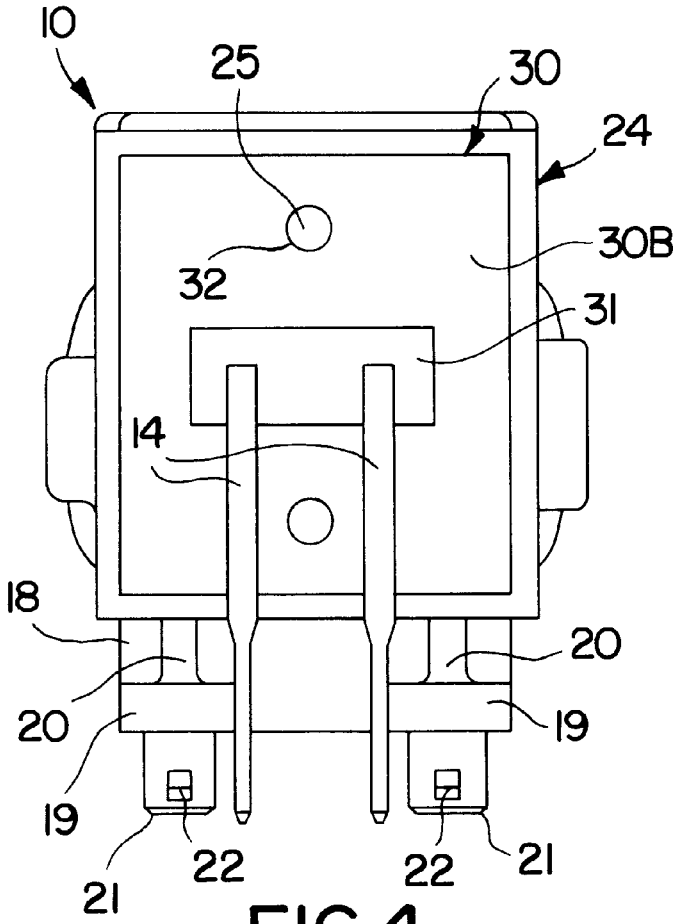
FIG. 4 is a rear view of the connector.
Figure 5:
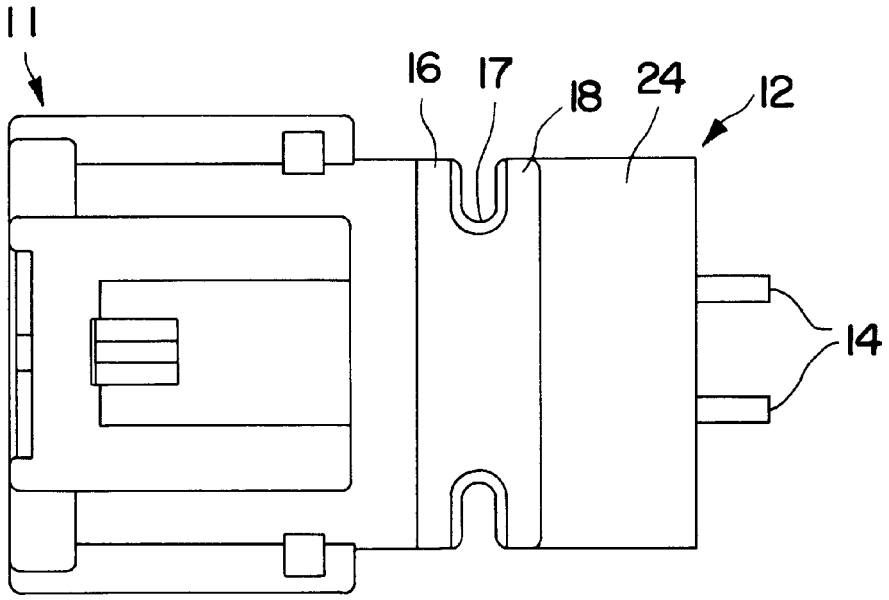
FIG. 5 is a plan view of the connector.
Figure 6:
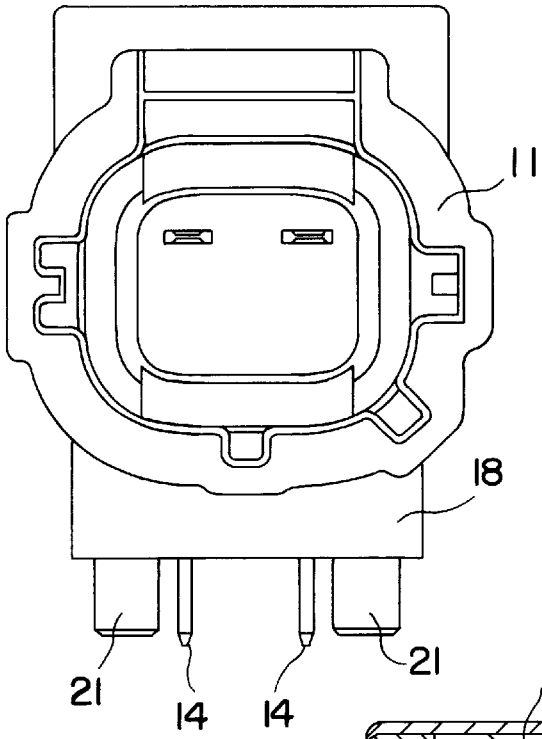
FIG. 6 is a front view of the connector.
Figure 7:
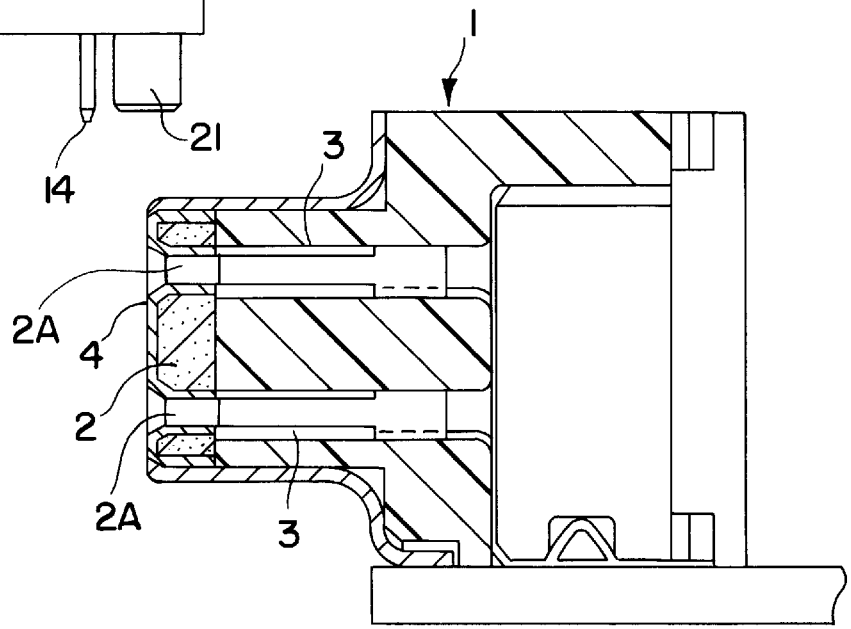
FIG. 7 PRIOR ART
FIG. 7 is a side view in section of a prior art connector.
Figure 8:
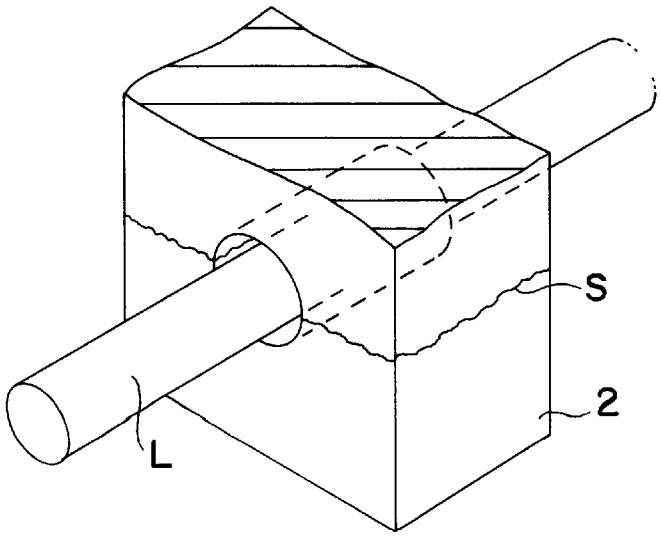
FIG. 8 PRIOR ART
FIG. 8 is a perspective view showing a cracked magnetic element of the prior art connector.

The mount base 12 is provided integrally with a magnetic element 30, preferably by insert-molding. The magnetic element 30 may be of generally toroidal or annular shape. As shown in FIG. 3(A), the magnetic element 30 has a substantially rectangular parallelepipedic shape, and a substantially rectangular hole 31 penetrates through the magnetic element 30 in its middle. As shown in FIG. 1, the magnetic element 30 is mounted in the housing 10 with a first end surface 30A thereof held substantially in contact with the rectangular plate 18 and the both tabs 14 inserted through the rectangular hole 31. A pair of fixing holes 32 penetrate through the magnetic element 30 in positions that preferably are substantially vertically symmetrical with respect to the rectangular hole 31. Each fixing hole 32 is stepped to widen at its opposite opening ends 32A, 32C so that the opposite opening ends have a larger diameter than the intermediate portion 32B of the fixing hole 32. Holding members 25 continuous with the rectangular flat 18 are formed e.g. by resin filled into the fixing holes 32 so that the magnetic elements 30 are securely fixed to the rectangular plate 18 by the holding members 25. Since the magnetic element 30 is made integral to the housing 10 by insert-molding in this connector, an operation step of assembling them can be omitted.

The housing 10 is formed integrally with a magnetic element receptacle 24 having a substantially rectangular tubular shape so as to enclose substantially the outer circumferential surface of the magnetic element 30. The bottom or rear end of an enclosing wall forming the magnetic element receptacle 24 is substantially flush with the first end surface 30A of the magnetic element 30 (see FIG. 1), and a second end surface 30B of the magnetic element 30 is exposed to the outside (see FIG. 4).

Next, the action and effects of the connector thus constructed are described.

This connector is transported from a manufacturing factory to an assembling factory, where it is assembled with an unillustrated mating part. Even if this connector is subjected to a shock during the transportation, the magnetic element 30 will not shake with respect to the housing 10 since it is integrally held by the housing 10 by insert-molding. In other words, the exertion of the shock on the magnetic element 30 caused by shaking can be prevented.

It can also be assumed that this connector may be struck by another part during transportation or during assembling. However, since the magnetic element 30 has its outer circumferential surface enclosed by the magnetic element receptacle 24, it is protected from contact with the other parts and, therefore, prevented from being cracked. Here, even if the magnetic element 30 should be cracked (see crack S in FIG. 3(B)), this crack can be easily found since the one end surface of the magnetic element 30 is exposed from the magnetic element receptacle 24, and can be dealt with by the exchange of the connector.

This connector is connected with the mating connector after being assembled with the mating part. Then, the tabs 14 of the connector and the terminal fittings of the mating connector are electrically connected to enable the bilateral transmission of signals between the two connectors. Here, noise transferred onto the electric conductive paths that extend backwardly of the respective connectors, is removed by the magnetic element 30 while being transmitted along the tabs 14. Thus noise is not transmitted beyond the tabs 14.

As described above, according to the connector of this embodiment, the assembling with the mating part with the magnetic element 30 being cracked can be prevented, thereby improving reliability in the noise removing function of the connector.

The present invention is not limited to the described and illustrated embodiment but, for example, the following embodiments are also embraced by the technical scope of the present invention as defined in the claims. Besides the following embodiments, a variety of other changes can be made without departing from the scope and spirit of the invention as defined in the claims.

Although the magnetic element 30 is made integral to the housing 10 by insert-molding in the connector of this embodiment, the magnetic element may be mounted in the housing after the housing is molded.

In the foregoing embodiment, the electric conductive portions (tabs 14) are inserted through the rectangular hole 31 of the magnetic element 30 before the connector is assembled or connected. However, for example, no electric conductive portions may penetrate through the magnetic element and, instead, the terminal fittings of the mating connector may penetrate through the magnetic element when the connectors are connected with each other.

Even though the magnetic element 30 has been described to be fixed to the connector housing 10 by means of insert molding protruding into fixing holes 32 formed in the magnetic element 30 thereby forming holding members 25, the magnetic element 30 may be alternatively or additionally fixed to the connector housing 10 by insert molding acting at least partially on the outer surface of the magnetic element 30, being preferably formed with one or more recesses and/or one or more projections.

Even though the invention has been described with reference to a substantially rectangular magnetic element, the annular or toroidal magnetic element may be formed having a round, elliptical or polygonal etc. shape.

What is claimed is:

1. A connector having a connector housing and an electric conductive path passing through the connector housing, a magnetic element in the connector housing and surrounding a portion of the electric conductive path, the magnetic element having an outer surface and opposed end surfaces, wherein the magnetic element is formed with at least one fixing hole, and wherein the connector housing is formed by insert molding around the magnetic element, such that the connector housing defines a unitary matrix of non-conductive material that forms a magnetic element receptacle, portions of the unitary matrix of non-conductive material that define the magnetic element receptacle substantially surrounding and engaging at least the outer surface of the magnetic element and substantially exposing one of said end surfaces of the magnetic element to the outside, the unitary matrix of non-conductive material further defining at least one holding member extending unitarily through the fixing hole for fixing the magnetic element in the magnetic element receptacle of the connector housing.

2. A connector according to claim 1, wherein the fixing hole has opposite opening ends and is stepped to widen at least at one of its opposite opening ends so that at least one of the opposite opening ends have a larger diameter than an intermediate portion of the fixing hole.

3. A connector according to claim 1, wherein said outer surface of the magnetic element is at least partially formed with at least one surface discontinuity surrounded and engaged by the unitary matrix.

4. A connector according to claim 3, wherein the magnetic element is provided with at least one opening for arranging therethrough the electric conductive path.

5. A connector according to claim 4, wherein the one opening is provided such that at least one tab at least partially projects into a receptacle of the housing for connection with a mating connector extend therethrough, the tab defining a portion of the electric conductive path.

6. A method for producing a connector having an annular magnetic element provided in a connector housing to remove a noise transmitted to an electric conductive path penetrating through the magnetic element, comprising the steps of:

providing an annular magnetic element having opposed end surfaces and inner and outer circumferential surfaces extending between the end surfaces, the magnetic element further having at least one fixing hole extending through the magnetic element from one of said end surfaces to the other of said end surfaces, positioning the magnetic element in a magnetic element receptacle mold cavity for the connector housing, and injecting a non-conductive material into the mold cavity to extend unitarily through the fixing hole and to substantially enclose the outer circumferential surface and one said end surface of the magnetic element while substantially exposing one end surface of the magnetic element to the outside.

7. The method of claim 6, wherein the step of providing the annular magnetic element comprises providing said annular magnetic element having at least one fixing hole that is stepped to widen at at least one of its opposite ends so that at least one of the opposite ends has a larger diameter than an intermediate portion of the fixing hole.

* * * * *